US006660124B1

(12) United States Patent
Kawasaki et al.

(10) Patent No.: US 6,660,124 B1
(45) Date of Patent: Dec. 9, 2003

(54) POLISHING SYSTEM AND POLISHING METHOD

(75) Inventors: Tetsu Kawasaki, Nirasaki (JP); Mitsuaki Iwashita, Nirasaki (JP)

(73) Assignee: Tokyo Electron Ltd., Tokyo (JP)

( * ) Notice: Subject to any disclaimer, the term of this patent is extended or adjusted under 35 U.S.C. 154(b) by 199 days.

(21) Appl. No.: 09/714,483

(22) Filed: Nov. 17, 2000

(30) Foreign Application Priority Data

Nov. 19, 1999 (JP) ..... 11-329074

(51) Int. Cl.[7] ..... B24B 21/18; B08B 7/00

(52) U.S. Cl. ..... 156/345.12; 216/85; 451/285

(58) Field of Search ..... 156/345.12; 216/85; 451/285, 6, 288

(56) References Cited

U.S. PATENT DOCUMENTS

| | | | | |
|---|---|---|---|---|
| 5,785,585 A | * | 7/1998 | Manfredi et al. | 451/288 |
| 6,095,908 A | * | 8/2000 | Torii | 451/285 |
| 6,106,369 A | * | 8/2000 | Konishi et al. | 451/41 |
| 6,126,848 A | * | 10/2000 | Li et al. | 216/85 |
| 6,132,289 A | * | 10/2000 | Labunsky et al. | 451/6 |
| 6,440,263 B1 | * | 8/2002 | Li et al. | 156/345.12 |

FOREIGN PATENT DOCUMENTS

| | | |
|---|---|---|
| JP | 6-190714 | 7/1994 |
| JP | 7-108453 | 4/1995 |
| JP | 8-255775 | 10/1996 |
| JP | 9-57608 | 3/1997 |
| JP | 10-217104 | 8/1998 |

* cited by examiner

*Primary Examiner*—Gregory Mills
*Assistant Examiner*—Sylvia R. MacArthur
(74) *Attorney, Agent, or Firm*—Finnegan, Henderson, Farabow, Garrett & Dunner LLP

(57) ABSTRACT

A wafer having a polished surface of copper is caused to contact a pad serving as an abrasive member, and the copper is polished while supplying a slurry containing mechanical and chemical polishing particles. Thereafter, when a finishing member of diamond having a large number of fine protrusions is scanned while the finishing member contacts the surface of the pad, a chelating agent, such as oxtail acid, is supplied to the surface of the pad as a dressing solution. Thus, reaction products, which have been produced by the reactions of copper with the slurry and which have adhered to the surface of the pad to be difficult to be dissolved in water, are dissolved, so that the reaction products can be removed in a short time. Thus, the reaction products having adhered to the abrasive member after polishing the wafer can be remove in a short time, so that the time required to carry out the CMP process can be shortened.

7 Claims, 7 Drawing Sheets

POLISHING SYSTEM AND POLISHING METHOD

BACKGROUND OF THE INVENTION

1. Field of the Invention

The present invention relates generally to a system and method for polishing a metal surface formed on a semiconductor device.

2. Description of Related Background Art

Processes for producing semiconductor wafers (which will be referred to as "wafers") include a process called CMP (chemical mechanical polishing). This CMP process is mainly used for polishing a layer of tungsten oxide in a semiconductor device which is formed by multi-layer metallization. This is a method for dropping an abrasive solution including mechanical and chemical polishing particles onto a surface of an abrasive cloth, which is an abrasive member, and for pressing a polished surface of the wafer against the abrasive cloth to remove a part of the polished surface.

In a conventional CMP process, in a system shown in, e.g., FIG. 9, a wafer W held by a wafer holding mechanism 13 is pressed against a rotating table 12, on which an abrasive cloth 11 serving as an abrasive layer has been formed, at a predetermined pressure. While an abrasive solution is supplied from a nozzle 14 to the surface of the abrasive cloth 11, the rotating table 12 is rotated, and the wafer holding mechanism 13 is rotated by a motor 15. Thus, the wafer W is caused to rotate on the rotating table 12 and to relatively revolve, so that the surface of the wafer W is polished. As the abrasive cloth 11, a foam resin, such as urethane foam, having a thickness of, e.g., about 1.2 mm, is used, and as the abrasive solution, a slurry, wherein silica ($SiO_2$) serving as mechanical polishing particles, and chemical polishing particles are dispersed in a solution, is used.

For example, the surface of the abrasive cloth 11 is dressed by a finishing member of diamond, on which fine protruding portions are formed, every time the wafer W is polished. Thus, the surface of the abrasive cloth 11 recovers its polishing capacity. On the other hand, the mixture and reaction products of the slurry (abrasive solution) with tungsten oxide, which are produced by the polishing, adhere to the surface of the abrasive cloth 11. The mixture and reaction products are removed by supplying, e.g., pure water, when the dressing is carried out, since the mixture and reaction products are dissolved in water.

By the way, in recent years, a technique for forming a copper wiring by a damascene process is widely noticed. This process requires a CMP process.

Conventionally, even if the mixture and reaction products of the slurry (abrasive solution) with tungsten oxide, which are produced by the polishing, adhere to the surface of the abrasive cloth 11, the mixture and reaction products can be removed only by supplying, e.g., pure water, when the dressing is carried out by the finishing member of diamond, since the mixture and reaction products are dissolved in wafer.

However, in the CMP process when forming a copper wiring by the damascene process, reaction products produced by a reaction of copper with a slurry, which is suitably used, are difficult to be dissolved in pure water due to the characteristics of the slurry. For that reason, the reaction products can not be removed by the same dressing as that in the case of tungsten oxide.

Referring to FIG. 10, this state will be explained. Irregularities 16 are formed on the surface of the abrasive cloth 11 by the dressing, and particles 17 of the above described reaction products come into spaces of the irregularities 16. In addition, the particles 17 also come into foam portions 18. These particles 17 remain without being washed.

If the reaction products produced at the polishing step thus adhere to the surface of the abrasive cloth, the polishing capacity deteriorates, and the uniformity of the polished surface also deteriorates. For that reason, the number of scans on the surface of the abrasive cloth by diamond has been increased to remove the reaction products. However, if the number of the scans is increased, the scraped portion of the abrasive cloth at the polishing step for a single wafer W increases to shorten the life of the abrasive cloth, and throughput lowers since the time required to carry out the finishing operation increases.

SUMMARY OF THE INVENTION

It is therefore an object of the present invention to eliminate the aforementioned problems and to remove reaction products, which adhere to an abrasive member after a substrate is polished, in a short time.

In order to accomplish the aforementioned and other objects, according to one aspect of the present invention, a polishing system comprises: polishing unit that polishes a metal constituting a polished surface of a substrate by supplying an abrasive solution having a chemical abrasive function to a polishing surface of an abrasive member while relatively sliding the polished surface and the abrasive member; chemical supply unit that supplies a chemical, which dissolves a reaction product produced by a reaction of the metal with the abrasive solution, to the polishing surface of the abrasive member; polishing surface finishing unit that scraps the polishing surface to recover a polishing capacity of the abrasive member by supplying a finishing fluid to the polishing surface while relatively sliding on the polishing surface of the abrasive member; and cleaning unit that supplies a cleaning solution to the polishing surface to remove the chemical from the polishing surface.

With this construction, the reaction product produced by the reaction of the metal constituting the polished surface with the abrasive solution can be dissolved in the chemical, and the abrasive member can be scraped by the polishing surface finishing member. Therefore, the polishing capacity of the abrasive member can be recovered in a short time, and the life of the pad can be increased.

This construction is effectively used if copper is used as the metal when the reaction product produced by the reaction of the metal with the abrasive solution is difficult to be dissolved in water.

The finishing fluid may be the chemical, and the polishing surface finishing unit may relatively slide on the polishing surface of the abrasive member while the chemical supply unit supplies the chemical to the polishing surface of the abrasive member.

By using the chemical as the finishing fluid, the polishing surface finishing unit can relatively slide on the polishing surface of the abrasive member while the chemical supply unit supplies the chemical to the polishing surface of the abrasive member, so that it is possible to efficiently carry out both of the dissolution of the reaction product in the chemical and the recovery of the polishing capacity of the abrasive member.

Alternatively, the finishing fluid may be the cleaning solution, and the polishing surface finishing unit may relatively slide on the polishing surface of the abrasive member while the cleaning unit supplies the cleaning solution to the polishing surface of the abrasive member.

By using the cleaning solution as the finishing fluid, the polishing surface finishing unit can relatively slide on the polishing surface of the abrasive member while the cleaning unit supplies the cleaning solution to the polishing surface of the abrasive member, so that it is possible to dissolve the reaction product in the chemical and it is possible to efficiently carry out both of the removal of the chemical from the polishing surface and the recovery of the polishing capacity of the abrasive member.

The cleaning unit may have a discharge nozzle for discharging the cleaning solution, which has been pressurized, to the polishing surface of the abrasive member.

Thus, the chemical supplied to the surface of the substrate can be surely removed in a short time.

The chemical may contain any one of oxtail acid, citric acid and ammonia.

The abrasive solution may contain any one of silica ($SiO_2$) alumina ($Al_2O_3$), hydrogen peroxide ($H_2O_2$) and phthalic acid.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

The preferred embodiment of the present invention intends to scrape a part of, e.g., a copper (Cu) layer, which is formed on the surface of a wafer W, by a CMP process which is a polishing process. This is carried out by, e.g., the following system.

In the preferred embodiment of the present invention, a chemical for dissolving a reaction product produced by a reaction of a metal of a wafer with an abrasive solution is used as a finishing fluid which is supplied when a polishing surface is scraped in order to recover the polishing capacity of the polishing surface of an abrasive member, and it slides relatively on the polishing surface of the abrasive member while the chemical is supplied to the polishing surface of the abrasive member from a chemical supply means. However, the present invention should not be limited thereto, but a cleaning solution supplied to the polishing surface to remove the chemical from the polishing surface may be used, and it may slide relatively on the polishing surface of the abrasive member.

Figure 1:
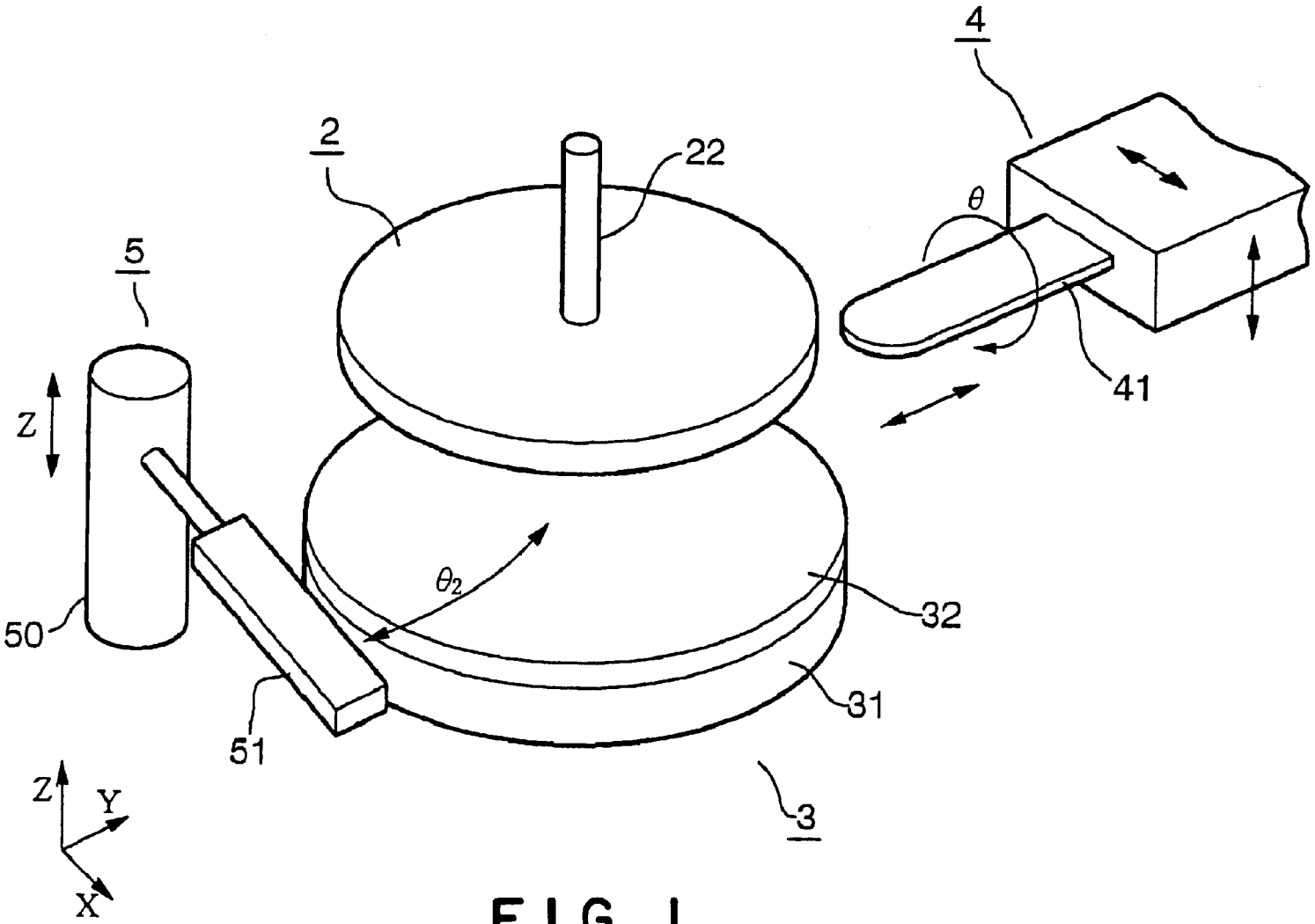
FIG. 1 is a perspective view of a preferred embodiment of a polishing system according to the present invention.
Figure 2:
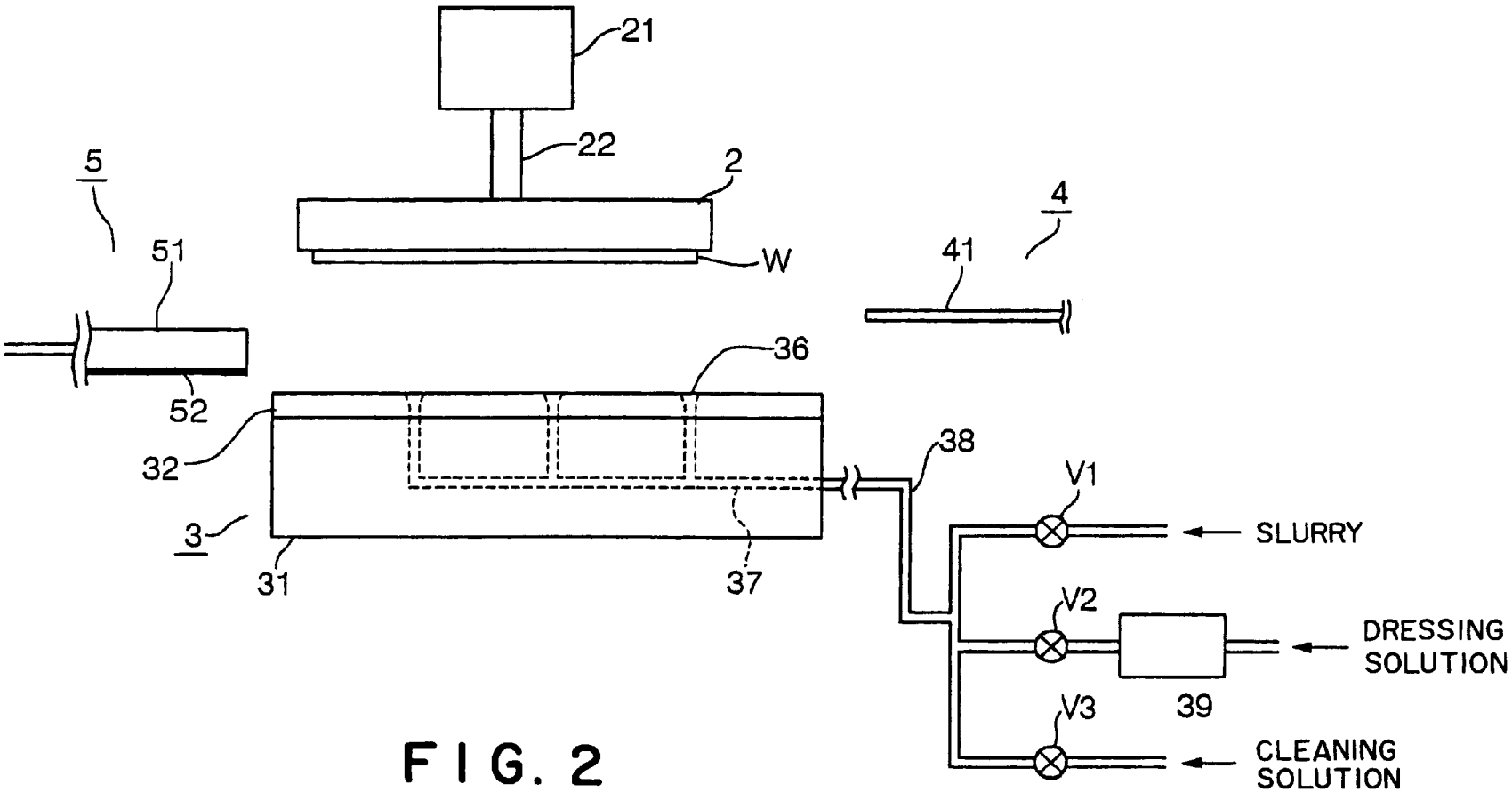
FIG. 2 is a schematic sectional view of a preferred embodiment of a polishing system according to the present invention.

FIGS. 1 and 2 are outside drawing and side view of an example of this preferred embodiment, respectively. Reference number 2 denotes a wafer holding part for absorbing and holding a wafer W from the top so as to turn the polished surface of the wafer W downwards. The wafer holding part 2 can be vertically moved by a lifting mechanism 21 and a supporting portion 22. A polishing part 3 is provided below the wafer holding part 2 so as to face the wafer holding part 2. The polishing part 3 comprises a rotating table 31 which is rotated by a driving mechanism 30, and a pad 32 serving as an abrasive member which is stuck on the top face of the rotating table 31. The pad 32 is made of a polyurethane foam resin having a thickness of, e.g., 1.2 mm. In the surface (polishing surface) of the pad 32, a group of fine protrusions 33 and recessed portions 34, which are formed by foaming, are formed (see FIG. 5(*a*)), and grooves 35 are formed so as to cross each other at right angles as shown in FIG. 3, so that a slurry and cleaning solution, which will be described later, are easy to flow.

Figure 4:
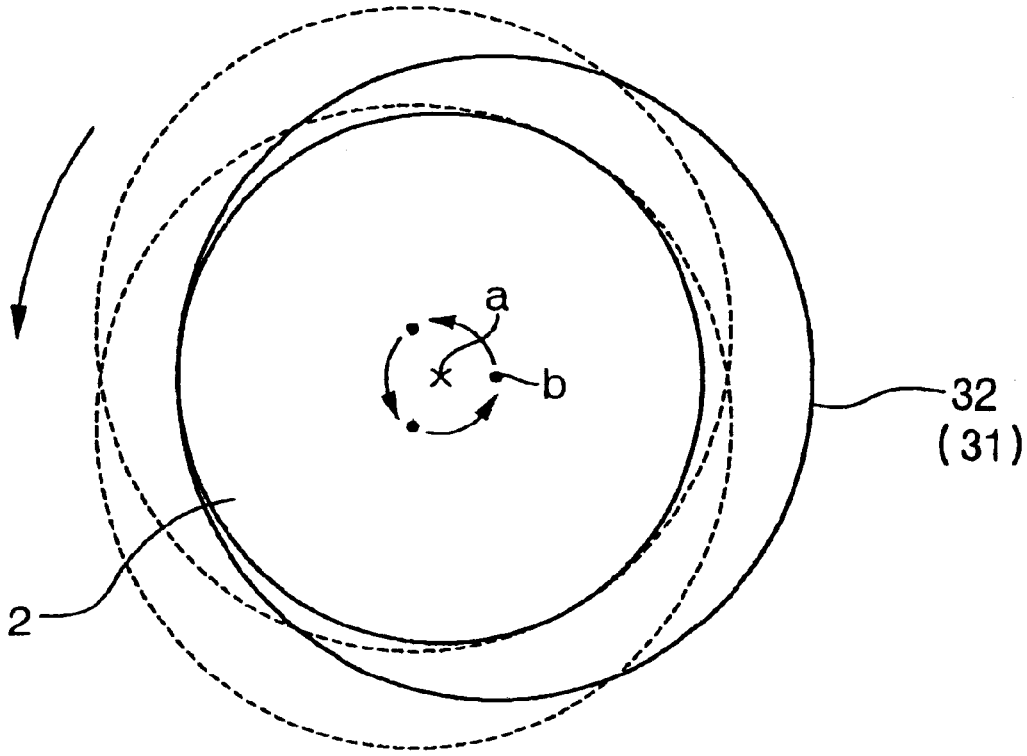
FIG. 4 is a plan view showing the surface of a pad 32 in the polishing system.

The size of the pad 32 (rotating table 31) is set so as to have a greater diameter than that of the wafer W which is absorbed and held by the wafer holding part 2. For example, a pad 32 having a diameter of 25 cm is used with respect to a wafer W having a diameter of 20 cm. The center of the wafer holding part 2 is eccentric from the center of the pad 32 by, e.g., about 3 cm, so that the driving mechanism 30 causes the pad 32 to revolve around the central axis of the wafer holding part 2 as shown in, e.g., FIG. 4.

Figure 3:
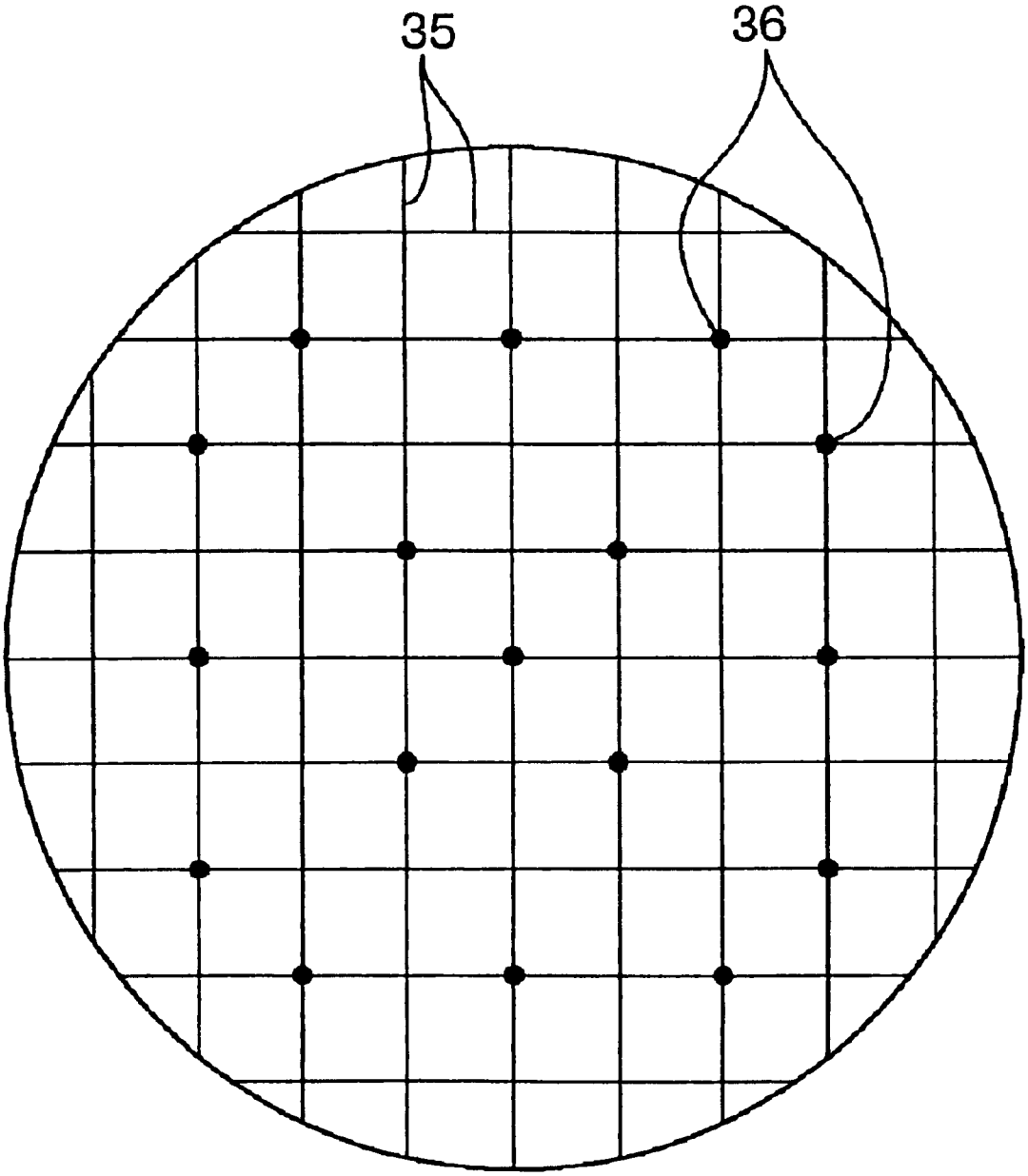
FIG. 3 is an illustration showing the operation of a rotating table 31 in the polishing system.

At predetermined intersection portions of the grooves 35, a plurality of holes 36 are formed so as to pass through the pad 32 as shown by, e.g., black points in FIG. 3. These holes 36 are in communication with a liquid feed passage 37 formed in the rotating table 31 as shown in FIG. 2.

The liquid feed passage 37 is connected to a slurry (abrasive solution) supply source (not shown), a dressing solution (chemical) supply source (not shown) and a cleaning solution supply source (not shown) via an external flexible pipe 38 and valves V1 through V3. In order to enhance the dissolving capacity of a dressing solution, a heating means 39 for heating the dressing solution to, e.g., 40° C., is provided between the dressing solution supply source and the valve V2.

The respective solutions supplied to the surface of the pad 32 from the liquid feed passage 37 will be described below.

The slurry (abrasive solution) is an abrasive solution supplied when the polished surface of the wafer W is polished by the pad 32, and contains mechanical polishing particles, such as silica ($SiO_2$) or alumina ($Al_2O_3$), chemical polishing particles, and an oxidizing agent, such as hydrogen peroxide ($H_2O_2$) or phthalic acid, for oxidizing copper.

The dressing solution (chemical) is a chemical of a material for dissolving reaction products (e.g., $Cu(OH)_2$ and CuO) of copper, which adhere to the surface of the pad 32 by polishing. As will be described later, in this preferred embodiment, the dressing solution is a finishing fluid which is supplied when the surface of the pad 32 is dressed by a dressing mechanism 5. In this case, for example, an organic substance having chelete effect, such as oxtail acid or citric acid, or ammonia may be utilized as the dressing solution.

The cleaning solution is used for washing the dressing solution after the dressing. For example, pure water is used as the cleaning solution.

In this preferred embodiment, a polishing system comprises a wafer transport mechanism 4 for delivering the wafer W between the polishing system and the wafer holding part 2, and a dressing mechanism 5 for recovering the polishing capacity of the pad 32. The wafer transport mechanism 4 comprises an arm 41 having a vacuum holding function. The wafer transport mechanism 4 is movable in X, Y and Z directions, and the arm 41 is rotatable so as to reverse the wafer W.

The dressing mechanism 5 comprises an arm 51 for scraping the surface of the pad 32 after a predetermined number of CMP processes, e.g., one CMP process, to form a new polishing surface to recover the polishing capacity, and a scanning mechanism 50 for horizontally swiveling the arm 51 between the peripheral and central portions of the wafer. The bottom of the tip portion of the arm 51 contacting the pad 32 is provided with a finishing member 52 of diamond crystal, on which a group of protrusions having a height of, e.g., about 160 microns, are formed.

In this preferred embodiment, as described above, the dressing solution (chemical) is also the finishing fluid which is supplied when the surface of the pad 32 is dressed by the dressing mechanism 5, and the polishing surface finishing means recovers the polishing surface by scraping the surface of the pad 32 by means of the dressing mechanism 5 while supplying the dressing solution (chemical) to the pad 32 from the dressing solution (chemical) supply source.

The operation of this preferred embodiment will be described below.

First, the wafer transport mechanism 4 holding the polished surface of the wafer W is moved to the vicinity of the wafer holding part 2. The arm 41 is herein reversed to cause the polished surface of the wafer W, which has turned upwards, turn downwards, so that the wafer W is vacuum-held by the wafer holding part 2. Then, the rotating table 31 starts, e.g., the above described orbital motion, by a driving mechanism (not shown), to move the wafer holding part 2 downwards from the top to cause the wafer W to contact the pad 32 at a predetermined pressure (see FIG. 5(*a*)).

At this time, the valve V1 is open to supply the slurry to the surface of the pad 32 from the holes 36. This slurry spreads to the periphery of the pad 32 by centrifugal force to pass through the grooves 35 to be supplied to the whole clearance of a portion, at which the pad 32 contacts the contact surface of the wafer W.

Figure 6:
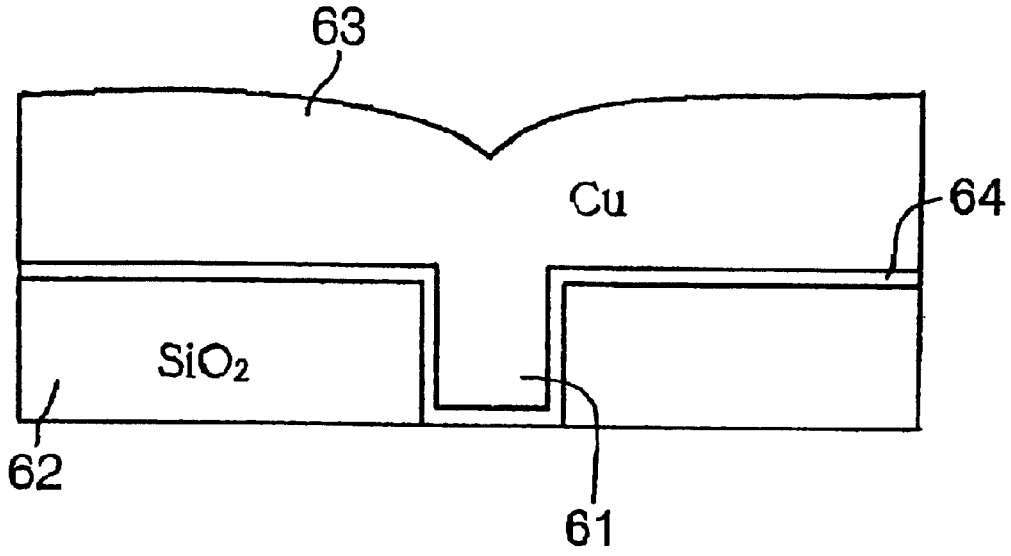
FIG. 6 is a sectional view showing a multi-layer metallization structure formed on the wafer W.

Thus, the polished surface of the wafer W is polished while the wafer W revolves with respect to the pad 32. With respect to the wafer W serving as an object to be polished, a process called, e.g., a damascene process for forming a copper wiring, is carried out. For example, as shown in FIG. 6, the wafer W is a wafer wherein copper 63 is stacked on a silicon oxide ($SiO_2$) layer 62 having a recessed portion 61. A copper wiring is formed by polishing the copper 63 until the $SiO_2$ layer 62 is exposed. In the drawing, reference number 64 denotes a barrier metal which is formed of a metal film of Ta (tungsten) or TaN (tungsten nitride) in order to prevent copper from diffusing.

It is considered that this polishing is carried out as follows. First, the oxidizing agent mixed with the slurry first oxidizes the surface of copper to form a layer of copper oxide which is mechanically friable. This portion is mechanically scraped by the mechanical polishing particles contained in the slurry and the irregularities on the surface of the pad 32. The polished waste material thus produced and the polished surface are etched by the chemical abrasive material contained in the slurry. Thus, a polished smooth surface is obtained. After the polishing of the wafer W is completed, the wafer holding part 2 is moved upwards, and the wafer W is replaced with the next wafer W.

Figure 5:
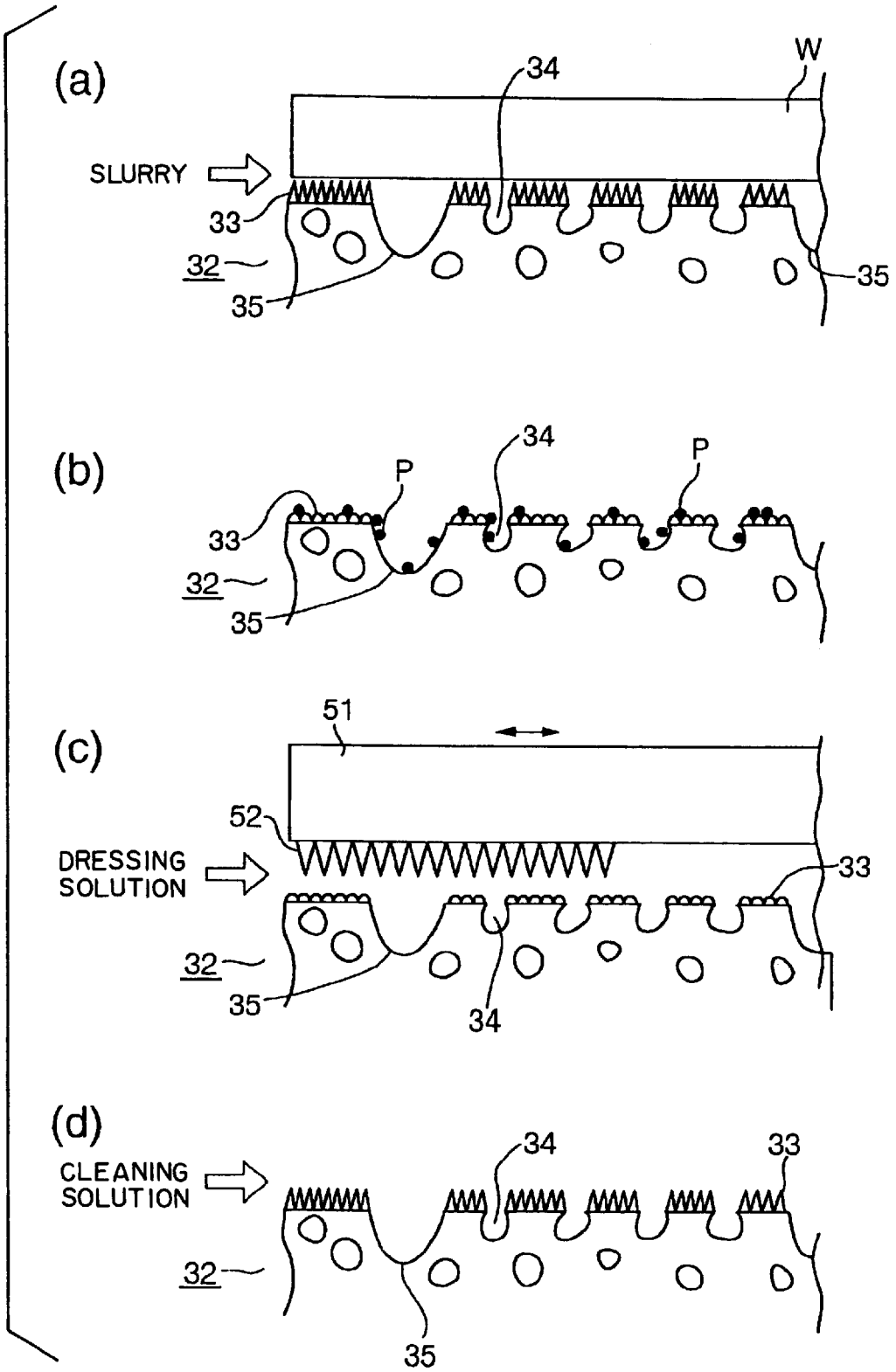
FIGS. 5(*a*) through 5(*d*) are illustrations showing the operations of the polishing of a wafer W and the dressing of the pad 32 in the polishing system.

On the other hand, when the wafer W is polished, the tip portions of the protrusions 33 on the surface of the pad 32 are rounded, and as described above, reaction products P, which have been produced by a reaction of copper with the slurry and which are difficult to be dissolved in water, come into the gaps of the protrusions 33 and the recessed portions 34 to cause so-called loading (see FIG. 5(*b*)).

Then, every time the polishing process for a predetermined number of wafers, e.g., one wafer W, is completed, the dressing mechanism 5 is operated to scan the arm 51, so that the dressing solution is supplied to the surface of the pad 32 while scraping the surface (protrusions 33) of the pad 33 by the protrusions of diamond serving as the finishing member 52 (see FIG. 5(*c*)).

The surface of the pad 32 is cut by, e.g., about 2 microns, so that new protrusions 33 are formed. Simultaneously, the above described reaction products P entering the recessed portions 34 and so forth are dissolved in the dressing solution, and the irregularities of the surface of the pad 32, together with the new protrusions 33, are recovered, so that the polishing capacity of the pad 32 is recovered.

Thereafter, the valve V2 is closed, and the arm 51 is moved to a standby position (not shown) outside of the polishing part 3. In addition, the valve V3 is open to supply wash water to the surface of the pad 32 to wash the remaining dressing solution to remove it from the surface of the pad 32 (see FIG. 5(*d*)).

As described above, according to this preferred embodiment, in the CMP process for polishing copper, the dressing solution, which contains an additive added to, e.g., oxtail acid having the dissolving capacity in the reaction product produced by the reaction of the slurry with copper, is supplied to the pad 32 after polishing the wafer to carry out the dressing (finishing process). Therefore, the reaction product produced by the reaction of the slurry with copper can be easily removed from the surface of the pad, and the polishing capacity of the pad 32 can be recovered only by, e.g., scanning the arm 51 once, so that it is possible to shorten the time required to carry out the whole CMP process and it is possible to increase the life of the pad.

In addition, the dressing solution is heated to, e.g., 40° C., to be supplied to the surface of the pad 32 so as to increase the dissolving rate of copper in the oxide, so that it is possible to more surely remove the reaction product. This heating must not always be carried out.

Figure 7:
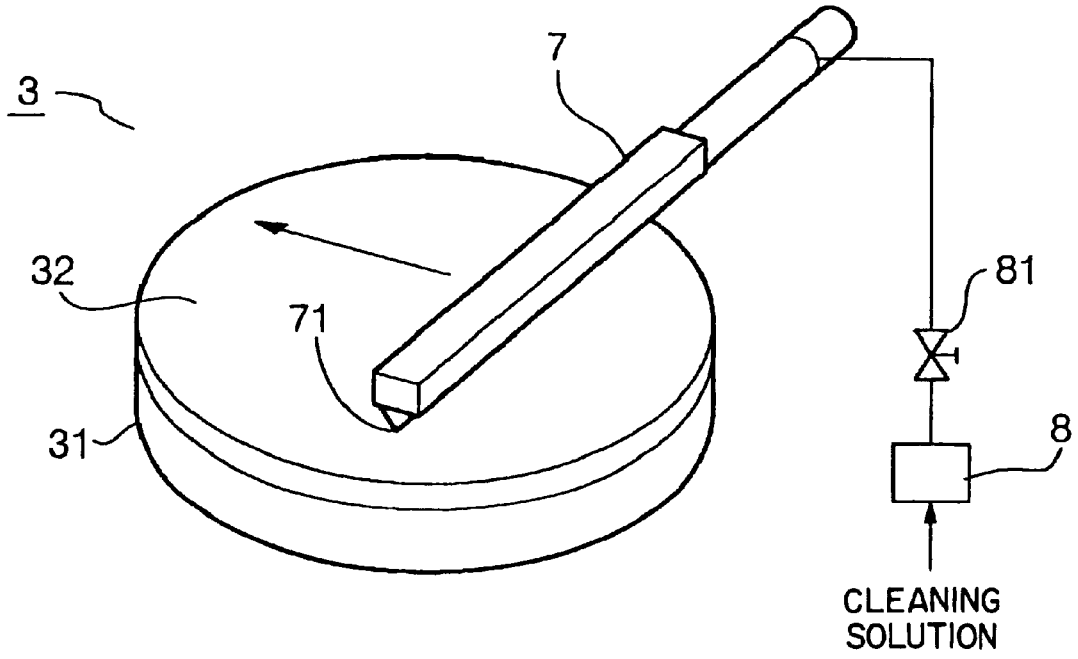
FIG. 7 is a schematic perspective view showing another preferred embodiment of a wash water supply means for use in the polishing system.
Figure 8:
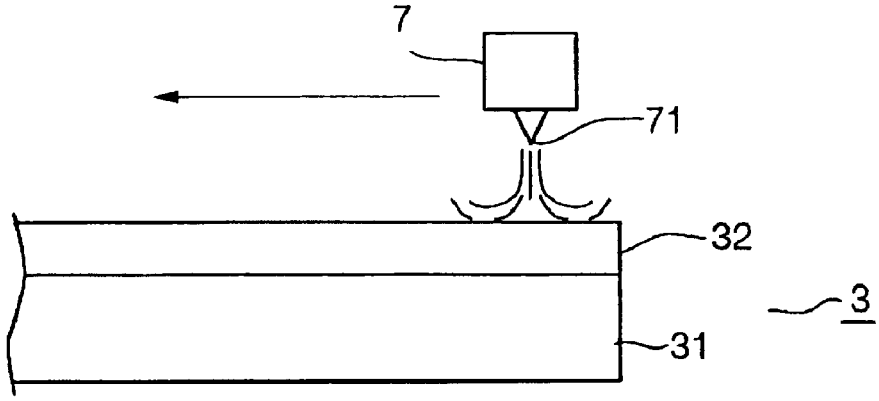
FIG. 8 is a sectional view showing another preferred embodiment of a wash water supply means for use in the polishing system.
Figure 9:
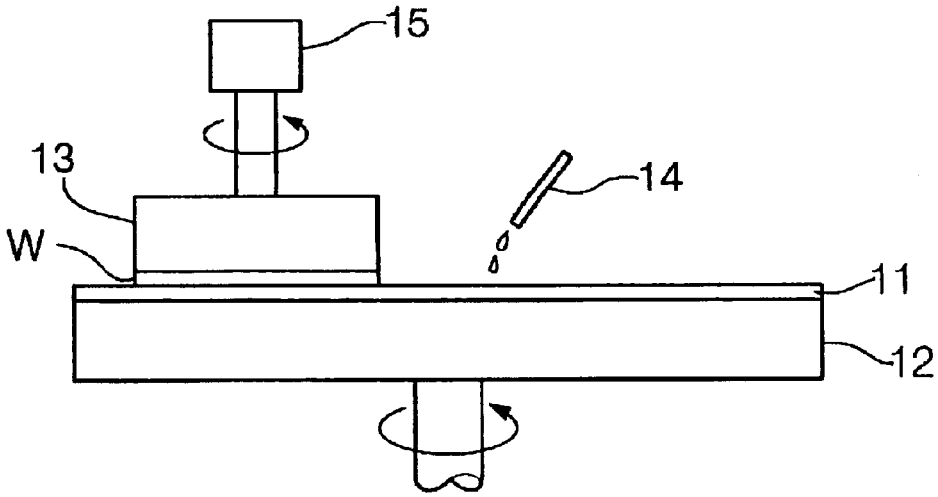
FIG. 9 is a schematic illustration showing an example of a conventional polishing system.
Figure 10:
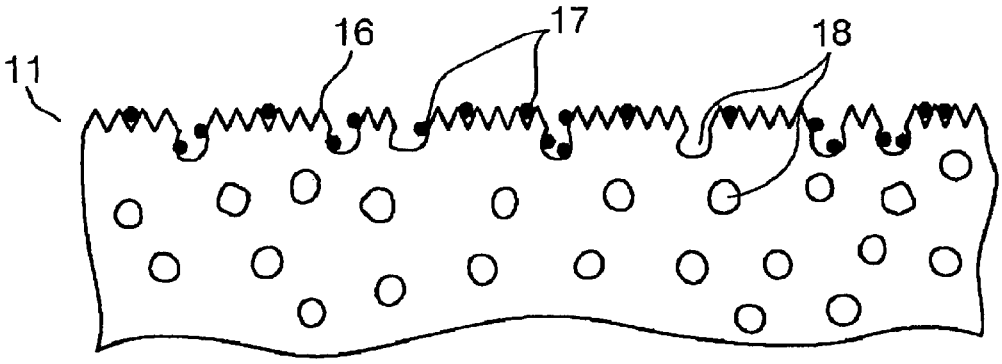
FIG. 10 is a sectional view showing the state of an abrasive cloth after a wafer is polished in a conventional polishing system.

Moreover, the supply of the cleaning solution to the surface of the pad 32 may be carried out by a supply means shown in, e.g., FIG. 7. This supply means comprises a supply nozzle 7 which is movable above the pad 32 in, e.g., radial directions. The bottom of the supply nozzle 7 has a plurality of discharge holes 71, which are aligned so as to correspond to the length of the diameter of the pad 32, so that the cleaning solution can be supplied to the pad 32. The supply nozzle 7 washes the remaining dressing solution by moving, e.g., from one end to the other end of the pad 32, while supplying the cleaning solution, e.g., pure water, which is pressurized by a booster pump 8 to be pressure-regulated by a pressure regulating means 81, from the discharge holes 71 to the surface of the pad 32.

According to such a supply means, the chemical, e.g., the dressing solution, which remains on the surface of the pad 32, can be surely removed in a short time.

In the above described preferred embodiment, every time the polishing process for a predetermined number of wafers, e.g., one wafer W, is completed, the dressing mechanism 5 is operated to scan the arm 51, so that the dressing solution is supplied to the surface of the pad 32 while the protrusions of diamond serving as the finishing member 52 scrape the surface (protrusions 33) of the pad 32. The dressing solution corresponds to a chemical for dissolving the reaction products, and to a finishing fluid which is supplied to scrape the surface of the pad 32 by the protrusions of diamond.

However, the present invention should not be limited thereto. After the chemical for dissolving the reaction products is supplied to the surface of the pad 32 to dissolve the reaction products, the cleaning solution supplied to remove the chemical from the surface of the pad 32 may be used as the finishing fluid, and the polishing capacity of the pad 32 may be recovered while supplying the cleaning solution to the surface of the pad 32. In this case, it is possible to dissolve the reaction products in the chemical, and it is possible to efficiently carry out both of the removal of the chemical from the surface of the pad 32 and the recovery of the polishing capacity of the pad 32.

In the above described preferred embodiment, while the chemical or the like has been supplied from the bottom of the pad 32 as shown in FIG. 2, it may be supplied from the top of the pad 32.

Thus, according to the present invention, it is possible to remove the reaction products, which have adhered to the abrasive member after polishing the substrate, in a short time, so that it is possible to shorten the required to carry out the CMP process.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A polishing system comprising:

a polishing unit for polishing a metal constituting a polished surface of a substrate, the polishing unit comprising an abrasive member having a polishing surface, wherein the polishing unit polishes the metal by supplying an abrasive solution functioning as a chemical abrasive to the polishing surface of the abrasive member while relatively sliding the polished surface of the substrate on the abrasive member;

a chemical supply unit for supplying a chemical to the polishing surface of the abrasive member, the chemical being configured to dissolve a reaction product produced by a reaction of the metal with the abrasive solution;

a polishing surface finishing unit for scraping the polishing surface of the abrasive member to recover polishing capacity of the abrasive member by supplying a finishing fluid to the polishing surface of the abrasive member while relatively sliding on the polishing surface of the abrasive member; and a cleaning unit for supplying a cleaning solution to the polishing surface of the abrasive member to remove the chemical and the reaction product dissolved by the chemical from the polishing surface.

2. The polishing system of claim 1, wherein the finishing fluid comprises the chemical, and the polishing surface finishing unit slides relatively on the polishing surface of the abrasive member while the chemical supply unit supplies the chemical to the polishing surface of the abrasive member.

3. The polishing system of claim 1, wherein the finishing fluid comprises the cleaning solution, and the polishing surface finishing unit slides relatively on the polishing surface of the abrasive member while the cleaning unit supplies the cleaning solution to the polishing surface of the abrasive member.

4. The polishing system of claim 1, wherein the cleaning unit comprises a discharge nozzle for discharging the cleaning solution to the polishing surface of the abrasive member, the cleaning solution having been pressurized.

5. The polishing system of claim 1, wherein the metal constituting the polished surface of the substrate comprises copper.

6. The polishing system of claim 1, wherein the chemical comprises at least one of oxtail acid, citric acid, and ammonia.

7. The polishing system of claim 1, wherein the abrasive solution comprises at least one of silica, alumina, hydrogen peroxide, and phthalic acid.

* * * * *

UNITED STATES PATENT AND TRADEMARK OFFICE

CERTIFICATE OF CORRECTION

PATENT NO. : 6,660,124 B1 
DATED : December 9, 2003
INVENTOR(S) : Tetsu Kawasaki and Mitsuaki Iwashita It is certified that error appears in the above-identified patent and that said Letters Patent is hereby corrected as shown below:

Title page,
Item [57], ABSTRACT,
Line 7, "oxtail" should read -- oxalic --.
Line 15, "remove" should read -- removed --.
Item [73], Assignee, "Tokyo Electron Ltd." should read -- Tokyo Electron Limited --.

Column 8,
Line 45, "oxtail" should read -- oxalic --.

Signed and Sealed this

Twenty-third Day of November, 2004

JON W. DUDAS
*Director of the United States Patent and Trademark Office*